United States Patent [19]

LaBudde

[11] 3,971,585

[45] July 27, 1976

[54] LOAD ENGAGING AND GRIPPING APPARATUS

[75] Inventor: Richard G. LaBudde, Batavia, N.Y.

[73] Assignee: GTE Sylvania Incorporated, Stamford, Conn.

[22] Filed: Mar. 17, 1975

[21] Appl. No.: 558,779

[52] U.S. Cl. ..... 294/88; 214/653

[51] Int. Cl.[2] ..... B66C 1/44; B66F 9/18

[58] Field of Search ..... 294/63 R, 67 R, 67 B, 294/67 BB, 67 BC, 81 R, 86 R, 87 R, 87.24, 87.26, 88, 99 R, 103 CG, 110 R; 214/620, 650–655, DIG. 4

[56] References Cited

UNITED STATES PATENTS

| | | | |
|---|---|---|---|
| 975,713 | 11/1910 | Penfield | 294/63 R |
| 2,536,151 | 1/1951 | Backofen et al. | 214/653 |
| 2,844,403 | 7/1958 | Farmer et al. | 294/87 R X |
| 2,896,994 | 7/1959 | Fischer | 214/655 X |
| 2,959,445 | 11/1960 | Breslav | 294/86 R |
| 2,974,995 | 3/1961 | Calhoun | 294/103 CG |
| 3,199,910 | 8/1965 | Bradley | 294/88 |
| 3,273,931 | 9/1966 | Caldwell et al. | 294/81 R |
| 3,319,815 | 5/1967 | Vik | 214/653 X |
| 3,438,669 | 4/1969 | Vik | 214/653 X |

*Primary Examiner*—Johnny D. Cherry
*Attorney, Agent, or Firm*—Norman J. O'Malley; Thomas H. Buffton; Robert T. Orner

[57] ABSTRACT

Load engaging and gripping apparatus for attachment to the lifting mechanism of a conventional lift truck for handling loads which are crushable and yet may be compressed slightly without damage thereto. The apparatus comprises a clamping assembly adapted for mounting on a lift mechanism of a lift truck with opposed load engaging and gripping platens forwardly thereof. Link members connect the platens to the lift assembly whereby when the opposed platens are in contact with the load under at rest condition and the lift assembly is then moved vertically upward said platens will be moved inwardly toward each other to frictionally and firmly grip the load therebetween for lift purposes.

6 Claims, 7 Drawing Figures

LOAD ENGAGING AND GRIPPING APPARATUS

CROSS REFERENCE TO OTHER APPLICATIONS

A concurrently filed application bearing U.S. Ser. No. 558,635 filed March 17, 1975 and entitled "Automatic Load Compensating Clamp Truck Jaws" relates to apparatus for enhanced clamp truck jaw operation.

SUMMARY OF THE INVENTION

This invention relates to load engaging and gripping apparatus for attachment to the lifting and clamp actuating mechanism of a conventional lift truck said apparatus is particularly adapted for use with loads which are crushable and yet may be compressed slightly without damage to the load unit.

Many attempts have been made to provide apparatus for a lift truck which will make the clamping and lifting of crushable loads an easy and completely foolproof operation. Most of such apparatus has proven completely unsatisfactory in that it either crushes the load or does not grip it firmly enough to retain it in position during the lifting operation.

In view of the foregoing, it is an object of this invention to provide load engaging and gripping apparatus for attachment to the lifting mechanism of a conventional lift truck that will firmly grip the load for lift purposes but will not crush same.

It is another object of this invention to provide load engaging and gripping apparatus which upon light engagement with the load will automatically firmly grip the load upon upward movement of the lifting mechanism of the lift truck.

It is yet another object of this invention to provide load engaging and gripping apparatus for attachment to the lifting mechanism of a conventional lift truck which apparatus comprises a lift assembly adapted for mounting on the lifting mechanism of a lift truck, opposed load engaging and gripping platens and means connecting the opposed platens to the lift assembly whereby when the opposed platens are in contact with the load under at rest conditions and the lift assembly is then moved vertically upward said platens will be moved toward each other to firmly grip the load therebetween for lift purposes.

IN THE DRAWINGS

FIG. 1 is a perspective view of a conventional lift truck with a preferred embodiment of the load engaging and gripping apparatus of this invention mounted thereon, FIG. 2 is an elevational view looking forwardly from behind the lift assembly and showing the platens in light engagement with the boxes to be lifted, FIG. 3 is an elevational view looking forwardly from behind the lift assembly and showing the position of the toggle links when the lift assembly has been raised and the platens pulled universally to compress and firmly grip the boxes held therebetween, FIG. 4 is an exploded view of a second embodiment of the load engaging and gripping apparatus of this invention, FIG. 5 is an elevational view of the embodiment of FIG. 4 looking forwardly from behind the lift assembly and showing, partly in broken away manner, the details of the bearing assemblies employed in supporting and controlling movement of the confronting platens, and further showing the platens in light engagement with the load, and FIG. 6 is an elevational view similar to FIG. 5 showing the position of the bearing members when the lift assembly has been raised and the platens pulled inwardly to frictionally and firmly grip the load therebetween, FIG. 7 is an exploded view of another embodiment of the bearing assembly of FIGS. 4, 5, and 6.

DETAILED DESCRIPTION OF THE INVENTION

For a better understanding of the present invention, together with other and further objects, advantages and capabilities thereof, reference is made to the following disclosure in conjunction with the appended claims and accompanying drawings.

Figure 1:
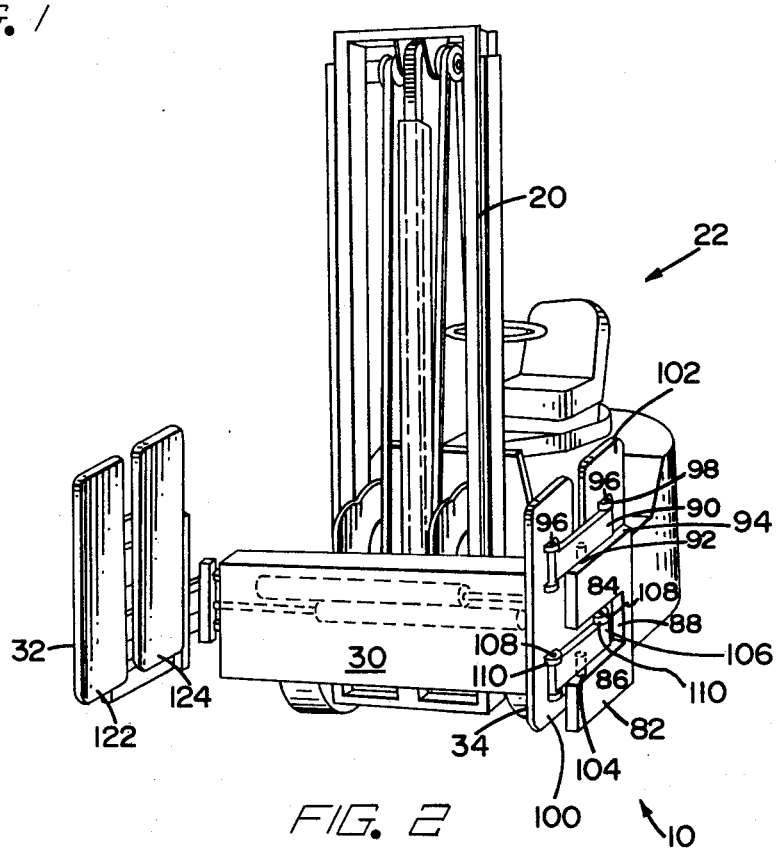

Referring to FIG. 1, there is shown the load engaging and gripping apparatus 10 of the invention secured to the lifting mechanism 20 of a conventional lift truck 22. More specifically the load engaging and gripping apparatus includes a lift assembly 30 which is the assembly actually attached to the lifting mechanism 20 of the lift truck 22 with opposed load engaging and gripping means 32 and 34 extending forwardly thereof.

Figure 2:
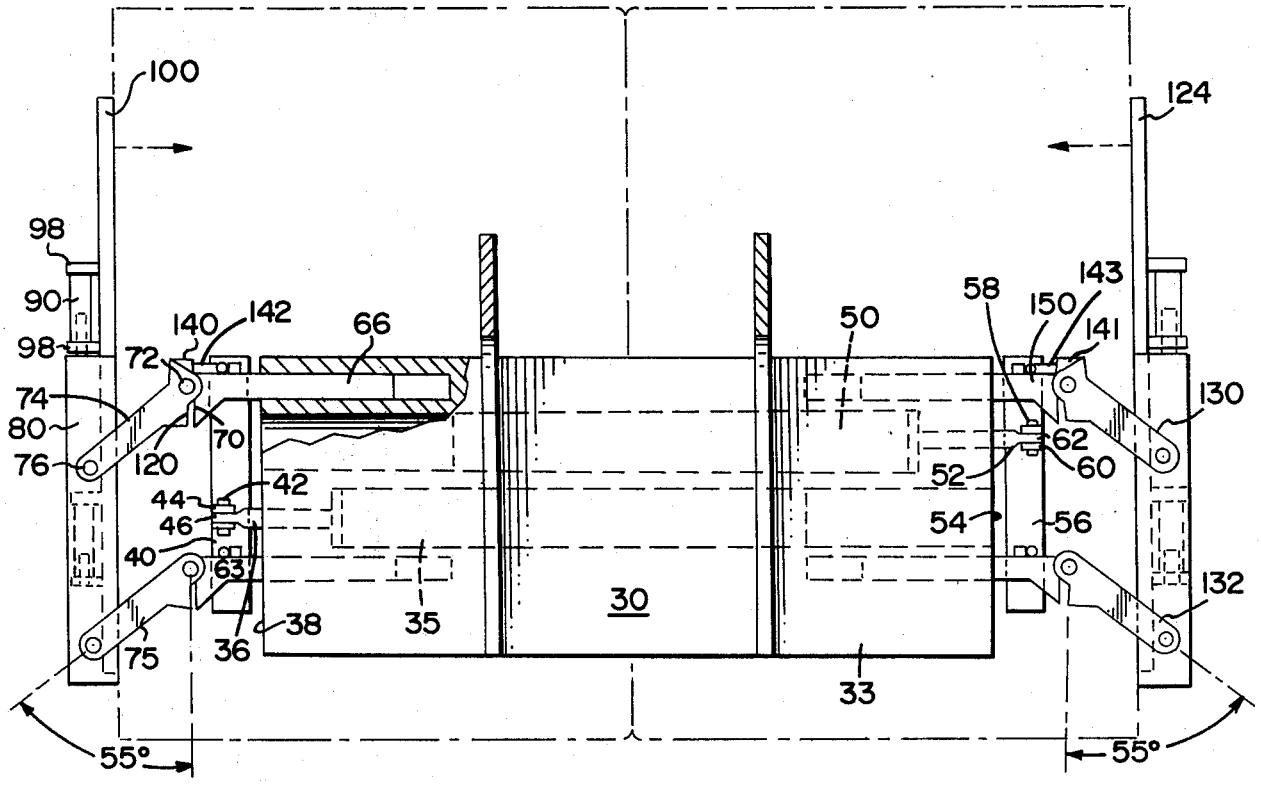
Figure 3:
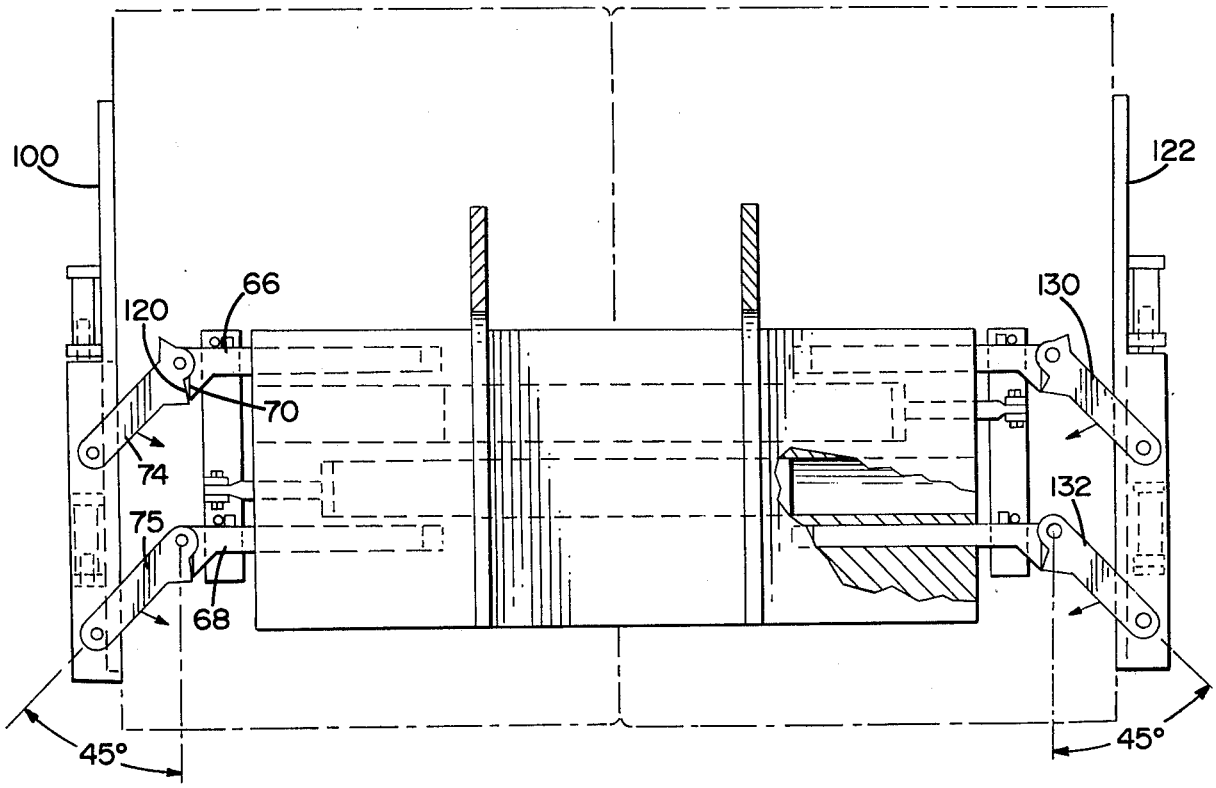

As illustrated in FIGS. 2 and 3, the load engaging and gripping apparatus 10 is shown as it would appear when looking forwardly from behind the lift assembly 30 as depicted in FIG. 1 of the drawings. Specifically the lift assembly 30 comprises a housing 33 internally mounting horizontally disposed double acting hydraulic cylinder 35 having its piston rod 36 extending outwardly beyond the left end 38 of the housing and connected to guide bar bracket 40 by means of pin 42 fitting through aligned openings in U-shaped support 44 on bracket 40 and apertured piston rod end 46. A similar arrangement is provided for the other side of the apparatus and comprises double acting hydraulic cylinder 50 having its piston rod 52 extending outwardly beyond the right end 54 of the housing and connected to guide bar bracket 56 by means of pin 58 fitting through aligned openings in U-shaped support 60 on bracket 56 and operational piston rod end 62.

Guide bar bracket 40 is reciprocally carried by means of upper and lower guide bars 66 and 68 to which it is attached, such guide bars have portions slidably mounted in the housing 30. The outer end of the guide bar 66 is provided with a depending stop portion 70 and an upper portion mounting a pin 72. A toggle arm 74 is pivotally mounted on pin 72 and is pivotally connected at its outer end by means of pin 76 to flange 80 of the platen bracket 82. (See FIG. 1). The platen bracket 82 comprises a U-shaped portion having parallel legs 84 and 86 joined by base 88 which terminates in an internal flange 80. Platen mounting plate 90 is pivotally mounted on pin 92 affixed to the upper face portion 94 of platen bracket leg 84. Bearing pins 96 are located on each end of plate 90 and are received by apertured legs 98 affixed to platens 100 and 102 so as to provide relative adjustability of said platens. A similar arrangement is provided on the lower leg 86 and comprises pin 104, plate 106, bearing pins 108 and apertured leg 110.

Platen assembly 32 is like and operates in the same manner as platen assembly 34; therefore, the structural details involved in accomplishing this will not be described further.

Referring to FIG. 3, the lift apparatus of this invention is illustrated as it appears in the at rest or fully compressed condition. More specifically, guide bar 66 is provided with a downwardly extending stop 70 which cooperates with depending stop shoulder 120 on toggle arm 74 to limit downward travel thereof. The remaining three toggle arms 75, 130 and 132 operate in the identical manner and combine to limit the downward and inward movement of opposed platens 100, 102 and 122, 124. Thus, FIG. 3 shows the opposed platens in the fully compressed condition, i.e., where the distance between the opposing platens is the least.

It has been determined that a controlled amount of compressing of the load is required in order to provide the necessary gripping action by the platens and yet prevent crushing of the load to such an extent that the load would be damaged. In this connection about 10° of pivotal movement of the toggle arms, depending upon the arm length, appears proper to accomplish the desired results. Referring to FIG. 3, the included angle between a vertical line through the center of the pivot point of toggle arm 75 and a line through the same point and the toggle arm 75 is 45° which represents the at rest or fully compressed position. In FIG. 2, the same included angle is 55° which represents the maximum open position which is the greatest distance the opposing platens 100 and 124 will be spaced from each other due only to action of the toggle arms 74, 75 and 130, 132.

In order to control the maximum open position of the opposing platens 100 and 124, toggle arm 74 is provided with an upper limit stop 140 which engages guide bar limit stop 142 on guide bar 66 to limit opening to a position wherein the included angle between a vertical line through the pivot point of toggle arm 74 and a line through the same pivot point and toggle arm 74 is 55°. A similar stop arrangement is provided for toggle arm 130 to also limit opening of the same included angle beyond 55° and includes an upper limit stop 143 on guide bar 150 and an upper limit stop 141 on toggle arm 130.

In operation, with the load engaging and gripping apparatus 10 in the "at rest" position of FIG. 3, the truck is maneuvered so that platens 122, 124 and opposite platens 100, 102 are positioned on opposing sides of the load, shown in dotted lines. After this the hydraulic cylinders 35 and 50 are actuated to move brackets 40 and 56 together with the toggle attached platens inwardly until the platens lightly contact the sides of the load. After this initial contact of the platens with the load, continued inward movement of the brackets 40 and 56 cause their respective toggle arms 74, 75, 130, 132 to pivot whereby the included angle between a vertical line through the toggle pivot on the guide bar and a line through the same pivot point and the toggle arm increases from the at rest position of 45° to 55° which is the maximum open position as previously described. An upper limit stop 140 on toggle arm 74 abuts against guide bar limit stop 142 on the guide bar 66 to limit the hydraulic clamping and included angle to 55°. Toggle arm 130 and associated guide bar 150 are provided with stops 141 and 143 similar to those on toggle arm 74 and guide bar 66 to likewise limit the included angle to 55° as in FIG. 2.

FIG. 2 of the drawings shows the load engaged by opposing platens 100, 102 and 122, 124 and wherein the included angle of the toggle arms is 55°. Next, the lift assembly 30 is raised by the lift mechanism 20 of lift truck 22. As the lift assembly 30 rises, the weight of the load will cause the load to drop downwardly carrying with it the pivotally mounted toggle arms 74, 75, 130 and 132. Said toggle arms will pivot downwardly about their pivot pins on their respective guide bars thus causing the opposing platens 100, 102 and 122, 124 to move inwardly toward each other and compress the load therebetween and thereby provide sufficient friction for the platens to firmly engage the load for lifting purposes. In the event that the load is quite compressible, the platens will be drawn inwardly toward each other until stop members 70 and 120 on the guide bar 66 and toggle arm 74 respectively abut each other to stop pivoting of the toggle arm 74. Each of the toggle arm-guide bar assemblies is provided with a like stop arrangement. These stops limit the movement to a point where the toggle arm included angle is 45°, which is the fully compressed condition shown in FIG. 3. This stop arrangement prevents undue crushing or dropping of the load which is essential for satisfying load handling and safety.

In order to release the load it is necessary to actuate hydraulic cylinders 35 and 50 to cause piston rods 36 and 52 respectively to move outwardly and cause the platens to move outwardly out of engagement with the load.

The controls and related hydraulic system for actuating the hydraulic cylinders 35 and 50, except for the limiting switch capabilities, together with the lifting mechanism is described in U.S. Pat. No. 2,795,346 and others; such apparatus does not form any part of this invention.

Figure 4:
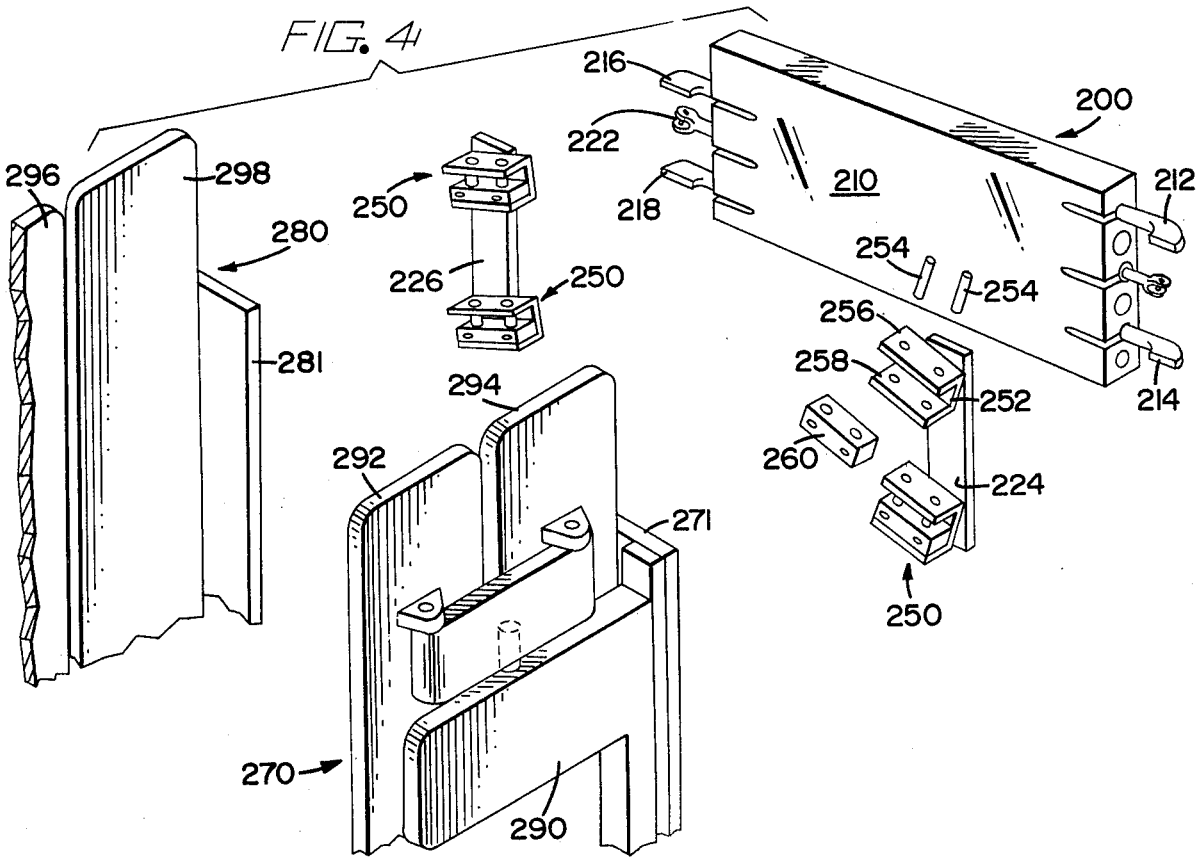
Figure 5:
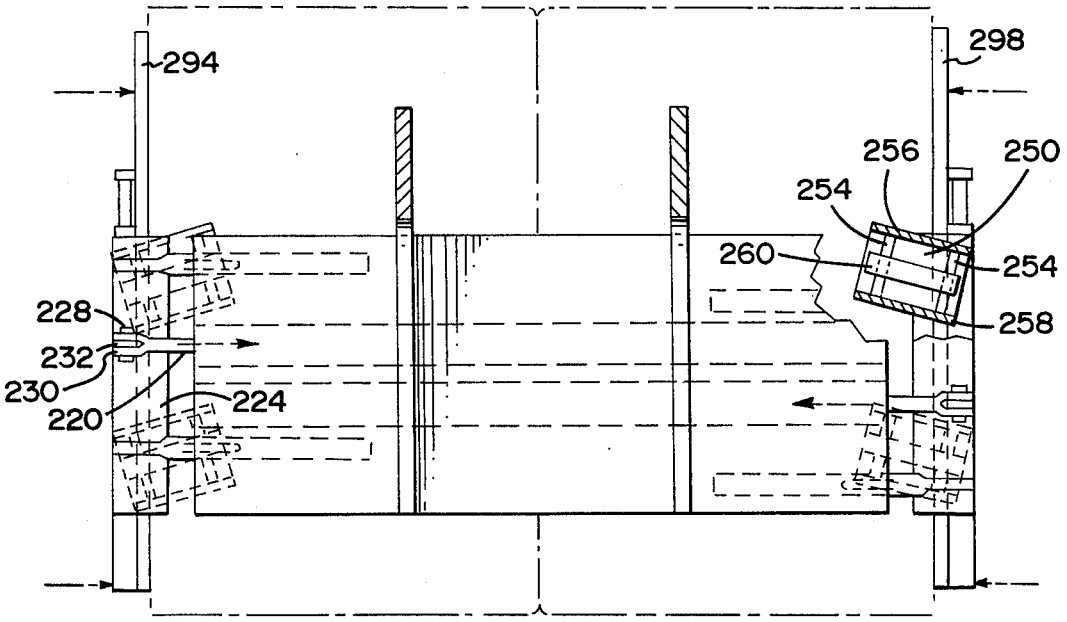
Figure 6:
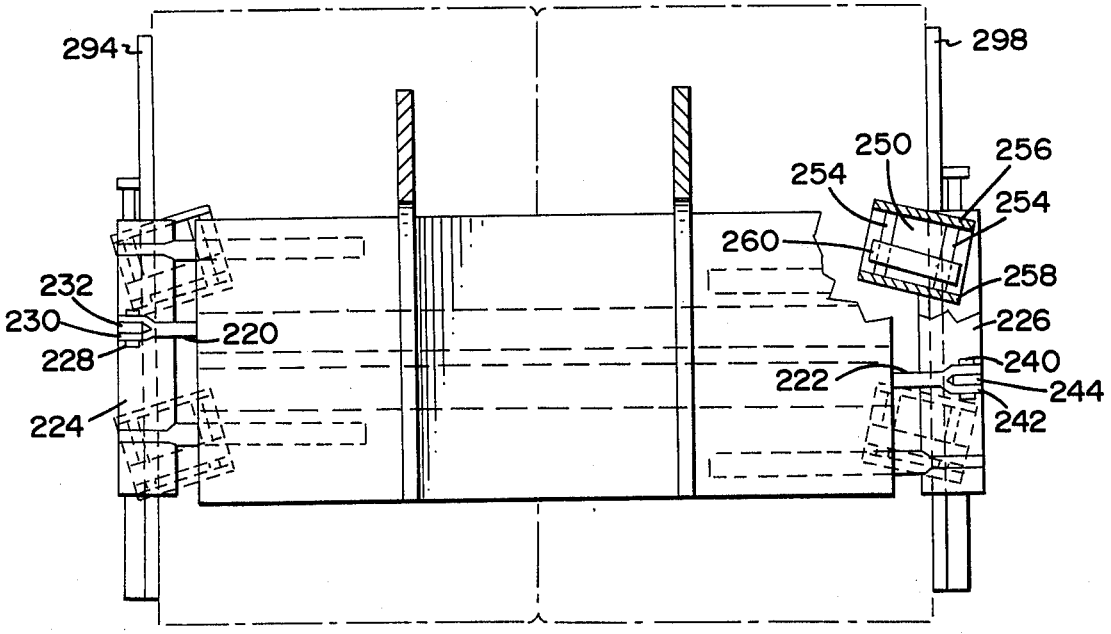

The second embodiment of this invention is shown in FIGS. 4–6; referring to FIG. 4 the lift assembly 200 is adapted for attachment to the lift mechanism 20 of the lift truck 22 of FIG. 1. The lift assembly 200 is substantially like that of the first embodiment and comprises a housing 210 with outwardly extending slidable guide bars 212, 214 on one end and guide bars 216 and 218 on the other end. The housing also mounts double acting hydraulic piston assemblies, having piston rods 220 and 222 extending from opposite ends of the housing. These piston rods reciprocate in the same manner as rods 36 and 52 of the first embodiment.

Referring to FIGS. 5 and 6, linear guide bearing assembly mounting plates 224 and 226 are secured to guide bars 212, 214 and 216, 218 respectively. Similarly, piston rod 220 is connected to mounting plate 224 by means of pin 228 extending through U-shaped bracket 230 and rod 220 and apertured support 232 on plate 224. Piston rod 222 is attached to mounting plate 226 in a similar manner which includes pin 240, U-shaped bracket 242 on piston rod 222 and apertured support 244 on plate 226.

A pair of linear guide bearing assemblies 250 are mounted on each mounting plate 224 and 226. Each bearing assembly 250 comprises a U-shaped guide bracket 252 having a pair of bearing pins 254 extending between opposed legs 256 and 258 of the bracket 252. A bearing 260 is apertured and slidably mounted on bearing pins 254 for movement between opposed bracket legs 256 and 258. The guide brackets 252 may be affixed to mounting plates 224 and 226 by welding or by bolts; the advantage of using bolts is that by providing extra apertures in the bracket 252 or the mounting platen, or both, a maximum of adjustability may be achieved with regard to the angularity of the brackets with respect to the mounting platen.

As best shown in FIG. 4, the platen assemblies 270 and 280 of the second embodiment are substantially like those in the first embodiment. For example platen assembly 270 comprises a U-shaped platen bracket 290 mounting platens 292 and 294 in the same manner as the respective platens 100, 102 of FIG. 1. The same arrangement is also provided for platens 296 and 298 of platen assembly 280. The platen assemblies 270 and 280 are provided with a bearing mounting bracket 271 and 281. The bearings 260 are mounted on these brackets and provide the important interconnection and action between the lift assembly 200 and the platen assemblies 270 and 280 to accomplish the objects of the invention.

It should be noted that the guide bracket assemblies 250 are positioned on the mounting platens 224 and 226 at an angle which is a few degrees up from the horizontal, i.e. 8° to 15° for example. The bracket assemblies are so positioned on the mounting platen that relative up and down movement between the lift assembly 200 and the platen assemblies 270 and 280 will cause the opposed platen assemblies 270 and 280 to move either inwardly toward each other or outwardly from each other thus varying the distance between the opposing platens. It is the inward motion of the opposed platens which causes said platens to grip the load positioned therebetween.

In view of the foregoing, operation of the second embodiment should appear clear upon referring to FIGS. 5 and 6. As will be readily apparent the maximum inward and outward travel of the platen assemblies for a specific position of the bearing assembly 250 is dependent upon movement of bearings 260 up and down on bearing pin 254 between bracket legs 256 and 258. In the at rest position the bearing 260 will be close to the bracket leg 256 which also is near the maximum outward distance that the platen assembly attached to the bearings can move.

In actual use the lift truck operator positions the opposing platens 292, 294 and 296, 298 on the opposite sides of the load with the platens in light engagement therewith. At this time the bearings 260 are in the lowermost position in the bracket 252. In order to raise the bearings 260 the operator lowers the lift assembly 200 and at the same time continues to draw the opposing platens inward in amount equal to the outward travel of the bearings 260 as they rise on bearing pins 254. The operator continues this until the bearings are raised at least half way up the bearing pins 254 thus achieving the condition illustrated in FIG. 5. With conditions as illustrated in FIG. 5, the operator may now cause the lift assembly 200 to move upward whereupon the weight of the load will cause the platens gripping the load to move inwardly as the load attempts to move downwardly under the pull of gravity. The inward movement of the platens is thus a function of the weight of the load, i.e., the heavier the load the more friction the platens will require to hold the load. Such friction is increased by downward and inward movement of the platens as caused by the supporting bearings 260. As illustrated in FIG. 6, the bearings 260 have come down forcing the platens inwardly to safely and securely frictionally grip the load for handling purposes.

Figure 7:
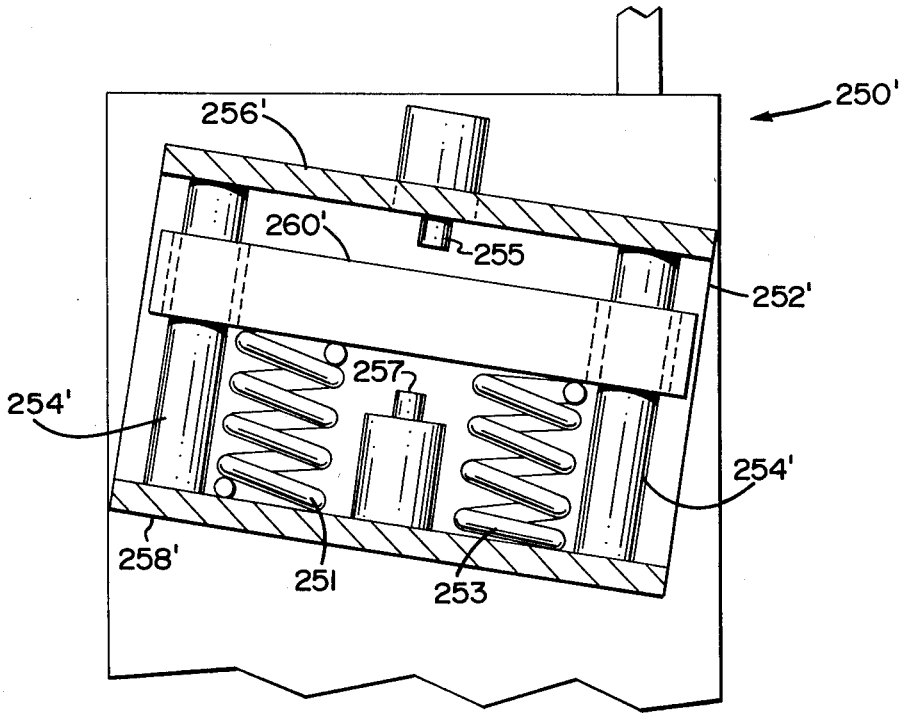

In another embodiment, illustrated in FIG. 7, a linear guide bearing assembly 250' is mounted on each of the mounting plates, 224 and 226 of FIG. 4. Each of the linear guide assemblies 250' comprises a U-shaped guide bracket 252' having a pair of bearing pins 254' extending between opposed legs 256' and 258' of the bracket 252'. A bearing 260' is apertured and slidably mounted on the bearing pins 254' for movement between opposed bracket legs 256' and 258'. The guide brackets 252' may be welded or bolted to the mounting plates 224' and 226'.

Additionally, this embodiment includes a pair of springs 251 and 253 disposed intermediate the bearing 260' and the one of the legs 258' of the guide bracket 252'. The springs 251 and 253 serve as a counter-balance spring system to compensate for the weight of the relatively heavy platen assemblies 270 and 280. Obviously, weights and other well-known techniques for effecting a counter-balance for the platen assemblies 270 and 280 are equally appropriate and applicable to the apparatus.

Further, a limit switch or valve 255 is affixed to the one leg 256' of the bracket 252' and disposed for selective activation by the bearing 260'. Another limit switch or valve 257 is affixed to the other leg 258' of the bracket 252' and also disposed for selective activation by the bearing 260'.

As to operation, the counter-balance springs 251 and 253 tend to position the bearing 260' near the bracket leg 256' which, in turn, causes the opposing platens 292, 294, 296, and 298 on opposite sides of a load to be on or about the maximum outward spacing. As an operator clamps a load by utilizing the hydraulic system to decrease the space intermediate the platens 292, 294 and 296, 298, the bearing 260' will be advanced toward the one leg 256' and the limit switch 255. Should an excess amount of clamping or hydraulic pressure be applied by the operator, the outward spacing of the platens will increase and the limit switch 255 will be activated by the bearing 260' whereupon the hydraulic system will be automatically immobilized. Thus, excessive clamping or package crushing due to operator error is eliminated.

Also, the weight of the load causes the platens 292, 294 and 296, 298 to advance toward one another as the load is lifted. In turn, the effect of the counter-balance springs 251 and 253 is overcome and the bearing 260' advances toward the other leg 258' of the bracket 252' and the other limit switch or valve 257.

Should the load crush or deform due to the pressure exerted thereon because of the weight compensating feature of the apparatus, there would normally be a tendency to drop or lose the load. However, a further advance of the bearing 260' due to crushing or deforming of the load causes activation of the limiting switch 257. Thereupon, the hydraulic system is activated and automatically increases the clamping pressure exerted upon the load. Thus, undesired dropping or loss of load due to increased crushing or deformation is prevented.

As mentioned earlier in the specificaion hydraulic controls for providing movement of the lift assembly 200 and the double action hydraulic piston and cylinder assemblies for inward and outward adjustment of the platen assemblies are well known in the prior art and do not constitute any part of this invention, except with regard to the above-mentioned counter balance and limit control modifications.

While there has been shown and described what is at present considered the preferred embodiments of the invention, it will be obvious to those skilled in the art that various changes and modifications may be made therein without departing from the invention as defined by the appended claims.

What is claimed is:

1. Load engaging and gripping apparatus for attachment to the lifting mechanism of a lift truck for handling loads, said apparatus comprising:

a lift assembly including reciprocable support means adapted for mounting on the lifting mechanism of a lift truck;

opposed load engaging and gripping means including engaging and gripping platens movably affixed to said reciprocable support means of said lift assembly, said movable affixation of said platens providing inward and outward travel thereof in response to vertical movement of said lift assembly; and power means in the form of a pair of double acting hydraulic piston and cylinder assemblies mounted on said lift assembly with one of said pair of assemblies connected to each of said opposed platens to provide inward and outward movement therebetween whereby frictional contact of a load by said platens is effected by said power means and added inward and outward movement of said platens is effected by said movable attachment to said lift assembly upon vertical movement of said lift assembly.

2. The apparatus of claim 1 wherein said movable affixation of said platens to said support means of said lift assembly is provided by toggle means.

3. The apparatus of claim 1 wherein said movable affixation of said platens to said support means of said lift assembly is provided by linear bearing assemblies.

4. The apparatus of claim 3 wherein each of said linear bearing assemblies comprises a bearing slidably mounted on a bearing pin means carried by a bearing pin support with the bearing and support operatively connected to the lift assembly and each of the opposed platens.

5. The apparatus of claim 4 wherein the bearing pin means are angularly disposed whereby the platens will move inwardly and outwardly in response to vertical reciprocation.

6. Load engaging and gripping apparatus for attachment to the lifting mechanism of a lift truck for handling crushable loads comprising:

a lift truck lifting assembly;

opposed load engaging and gripping platens formed for contact with a crushable load;

power means for varying the distance between the platens; and means for coupling said opposed load engaging and gripping platens to said lifting assembly, said means for coupling said opposed load engaging and gripping platens to said lifting assembly including a linear guide bearing assembly having a slidable bearing mounted on a bearing pin and disposed intermediate a pair of bracket legs, counter-weight spring means contacting said bearing and one of said bracket legs, and a limit switch means intermediate each one of said pair of bracket legs and said bearing whereby one of said limit switch means automatically deactivates said power means when excess pressure is applied to a load by said platens and another of said limit switch means activates said power means to effect application of increased pressure to said load when insufficient pressure is applied by said platens.

* * * * *